US011812871B2

(12) United States Patent
O'Hara

(10) Patent No.: US 11,812,871 B2
(45) Date of Patent: Nov. 14, 2023

(54) CHAIR WITH APPENDAGE ACCOMMODATIONS

(71) Applicant: Buzz Seating, Inc., Cincinnati, OH (US)

(72) Inventor: Daniel O'Hara, Cincinnati, OH (US)

(73) Assignee: Buzz Seating, Inc., Cincinnati, OH (US)

( * ) Notice: Subject to any disclaimer, the term of this patent is extended or adjusted under 35 U.S.C. 154(b) by 0 days.

(21) Appl. No.: 17/193,197

(22) Filed: Mar. 5, 2021

(65) Prior Publication Data

US 2021/0345783 A1 Nov. 11, 2021

Related U.S. Application Data

(63) Continuation of application No. 16/552,687, filed on Aug. 27, 2019, now Pat. No. 10,945,530, which is a continuation of application No. 15/966,836, filed on Apr. 30, 2018, now Pat. No. 10,426,269.

(51) Int. Cl.

| | |
|---|---|
| ***A47C 1/024*** | (2006.01) |
| ***A47C 3/026*** | (2006.01) |
| ***A47C 7/54*** | (2006.01) |
| ***A47C 1/03*** | (2006.01) |
| ***A47C 1/032*** | (2006.01) |

(52) U.S. Cl.

CPC ..... *A47C 7/543* (2013.01); *A47C 1/024* (2013.01); *A47C 1/032* (2013.01); *A47C 1/0303* (2018.08); *A47C 1/03255* (2013.01); *A47C 1/03266* (2013.01); *A47C 3/026* (2013.01); *A47C 7/541* (2018.08)

(58) Field of Classification Search

CPC ..... A47C 7/543; A47C 1/0303

USPC ..... 297/285, 296, 297, 411.32, 411.35, 297/411.36, 411.38, 452.14, 452.15, 297/344.19, 341, 342, 343, 411.37; D6/366, 716.4; 248/188.7

See application file for complete search history.

(56) References Cited

U.S. PATENT DOCUMENTS

| | | | | |
|---|---|---|---|---|
| 4,373,692 A | | 2/1983 | Knoblauch et al. | |
| 4,451,084 A | * | 5/1984 | Seeley | A47C 7/402 297/353 X |
| 4,466,665 A | * | 8/1984 | Aronowitz | A47C 1/0303 297/353 X |
| 4,639,039 A | * | 1/1987 | Donovan | A47C 7/402 297/353 X |
| D288,747 S | | 3/1987 | Schultz | |
| 4,749,230 A | * | 6/1988 | Tornero | A47C 7/402 297/353 X |

(Continued)

OTHER PUBLICATIONS

U.S. Appl. No. 15/966,836 U.S. Pat. No. 10,426,269, filed Apr. 30, 2018, Chair With Appendage Accommodations.

(Continued)

*Primary Examiner* — Rodney B White

(74) *Attorney, Agent, or Firm* — Schwegman, Lundberg & Woessner, P.A.

(57) ABSTRACT

A chair includes a back member and arm brackets. The back member is tapered toward an end that is adjacent to a seat. The arm brackets are attached under a bottom portion of the seat. Each arm bracket is adjustable to provide a seat clearance area for the seat when one or more of the arm brackets are adjusted up to approximately 90 degrees from an original upright position.

16 Claims, 13 Drawing Sheets

(56) References Cited

U.S. PATENT DOCUMENTS 4,840,426 A 6/1989 Vogtherr et al.
5,037,158 A * 8/1991 Crawford ..... A47C 7/402 297/353
5,042,876 A 8/1991 Faiks
5,106,157 A 4/1992 Nagelkirk et al.
D327,988 S 7/1992 Citterio
D328,199 S 7/1992 Citterio
D330,809 S 11/1992 Citterio
D332,011 S 12/1992 Fahnstrom et al.
D332,182 S 1/1993 Citterio
D339,927 S 10/1993 Fahnstrom et al.
5,338,133 A * 8/1994 Tornero ..... A47C 1/03 297/411.37 X
5,407,249 A * 4/1995 Bonutti ..... A47C 16/00 297/411.35
D363,401 S 10/1995 Wingerter
5,536,070 A * 7/1996 Lemmen ..... A47C 7/541 297/411.37 X
5,577,804 A 11/1996 Tedesco
5,630,649 A 5/1997 Heidmann et al.
D380,110 S 6/1997 Tortel
5,649,741 A * 7/1997 Beggs ..... A47C 7/402 297/353
5,660,442 A * 8/1997 Tornero ..... A47C 1/03 297/411.37 X
5,752,684 A * 5/1998 Larkin ..... A47C 7/004 248/188.7
5,755,650 A * 5/1998 Urso ..... A47C 9/002 297/411.35 X
D394,961 S 6/1998 Fancelli
5,765,804 A 6/1998 Stumpf et al.
5,839,784 A * 11/1998 Breen ..... A47C 1/0307 297/411.35 X
D401,771 S 12/1998 Goodworth et al.
5,944,387 A * 8/1999 Stumpf ..... A47C 1/03 297/411.37
5,951,107 A * 9/1999 Tornero ..... A47C 7/402 297/353
5,951,109 A * 9/1999 Roslund, Jr. ..... A47C 1/03266 297/383
5,975,639 A * 11/1999 Wilson ..... A47C 1/03 297/411.35
6,027,169 A 2/2000 Roslund
6,059,239 A * 5/2000 Wheeler ..... A47C 7/004 248/188.7
6,059,363 A * 5/2000 Roslund, Jr. ..... A47C 1/03272 297/353
6,257,668 B1 7/2001 Chou et al.
6,264,276 B1 * 7/2001 Chen ..... A47C 7/402 297/353
6,276,757 B1 * 8/2001 Brown ..... A47C 7/402 297/353
6,296,313 B1 * 10/2001 Wu ..... A47C 1/0307 297/411.35 X
6,299,253 B1 * 10/2001 Chen ..... A47C 7/402 297/353
D451,293 S 12/2001 Su
D451,313 S 12/2001 Tseng
D451,692 S 12/2001 Hasenbein
6,361,110 B2 3/2002 Roslund, Jr. et al.
D456,626 S 5/2002 Su
6,394,548 B1 5/2002 Battey et al.
6,394,549 B1 5/2002 Dekraker et al.
6,409,266 B1 * 6/2002 Chen ..... A47C 1/03 297/411.35 X
6,425,633 B1 7/2002 Wilkerson et al.
D461,323 S 8/2002 Su
6,460,928 B2 10/2002 Knoblock et al.
D467,748 S 12/2002 Lepper et al.
D467,749 S 12/2002 Lepper et al.
D470,668 S 2/2003 Mizell
6,523,895 B1 2/2003 Vogtherr
6,540,296 B1 * 4/2003 Shats ..... A47C 7/402 297/353
6,572,195 B1 * 6/2003 Lee ..... A47C 1/0307 297/411.37
D479,416 S 9/2003 Raftery
6,626,497 B2 9/2003 Nagamitsu et al.
6,659,560 B1 * 12/2003 Chi ..... A47C 4/028 297/411.37 X
D484,710 S 1/2004 Getzel
D486,657 S 2/2004 Su
D490,621 S 6/2004 Newhouse
D494,768 S 8/2004 Su
D495,509 S 9/2004 Breen
6,837,545 B1 * 1/2005 Ho ..... A47C 1/03 297/411.36
D507,437 S 7/2005 Klaasen et al.
D510,488 S 10/2005 Su
7,093,904 B1 * 8/2006 McMillen ..... A47C 7/543 297/411.32
7,114,777 B2 10/2006 Knoblock et al.
7,243,997 B1 * 7/2007 Tornero ..... A47C 1/03 297/411.37 X
D566,410 S 4/2008 Neil
7,357,051 B2 * 4/2008 Raum ..... B60N 2/0806 248/424
D570,625 S 6/2008 Schweikarth et al.
7,427,105 B2 9/2008 Knoblock et al.
D579,682 S 11/2008 Neil
D583,580 S 12/2008 Hara
7,618,090 B2 * 11/2009 Grenon ..... A47C 3/18 248/188.7
7,669,935 B2 3/2010 Crossley et al.
D618,927 S 7/2010 Zhang
7,770,979 B2 * 8/2010 He ..... A47C 1/0305 297/411.36
7,832,805 B1 11/2010 Lai
D639,576 S 6/2011 Breen
D640,477 S 6/2011 Neil
D640,478 S 6/2011 Neil
D646,093 S 10/2011 Collinson
8,104,838 B2 * 1/2012 Tsai ..... A47C 1/0307 297/411.37 X
D704,945 S 5/2014 Massaud
D714,563 S 10/2014 Amdal et al.
8,876,209 B2 11/2014 Peterson et al.
8,973,990 B2 3/2015 Krupiczewicz et al.
8,998,339 B2 4/2015 Peterson et al.
D736,006 S 8/2015 Wold et al.
9,307,839 B2 * 4/2016 Cvek ..... A47C 1/0305
9,326,607 B2 5/2016 Tsai
D792,120 S 7/2017 Webb
D792,717 S 7/2017 Webb
D793,112 S 8/2017 Webb
D800,469 S 10/2017 Barber et al.
D800,470 S 10/2017 Barber et al.
D800,471 S 10/2017 Barber et al.
D800,472 S 10/2017 Meda
D801,066 S 10/2017 Barber et al.
D801,067 S 10/2017 Barber et al.
D801,717 S 11/2017 Barber et al.
D801,718 S 11/2017 Barber et al.
D802,314 S 11/2017 Barber et al.
10,426,269 B1 10/2019 O'Hara
10,918,213 B2 * 2/2021 Fryer ..... A47C 7/38
10,945,530 B2 3/2021 O'Hara
2002/0063460 A1 * 5/2002 Roslund, Jr. ..... A47C 7/402 297/353
2002/0140266 A1 * 10/2002 Broekhuis ..... A47C 3/265 297/353
2005/0093358 A1 * 5/2005 Matern ..... A47C 1/0305 297/411.36
2005/0093359 A1 * 5/2005 Hobb ..... A47C 1/03 297/411.36
2006/0250018 A1 * 11/2006 Tsai ..... A47C 1/0307 297/411.36
2007/0040424 A1 * 2/2007 Neustat ..... A47C 7/72 297/219.1
2007/0052275 A1 3/2007 Ghilzai

(56) References Cited

U.S. PATENT DOCUMENTS

2007/0085402 A1* 4/2007 Hu ..... A47C 1/0303 297/411.36
2007/0164594 A1 7/2007 Yang
2007/0200415 A1* 8/2007 Eberlein ..... A47C 1/0307 297/411.37
2008/0036265 A1* 2/2008 Pan ..... A47C 1/0305 297/411.36
2008/0054700 A1 3/2008 Meidan
2008/0079302 A1* 4/2008 Grove ..... A47C 1/03 297/411.36
2008/0309140 A1* 12/2008 Ho ..... A47C 1/03 297/411.36
2010/0123346 A1* 5/2010 Lin ..... A47C 1/03 297/411.37
2010/0244531 A1* 9/2010 Pai ..... A61P 3/04 297/411.36
2011/0140498 A1* 6/2011 Tsai ..... A47C 1/03 297/411.38
2011/0248542 A1* 10/2011 Tsai ..... A47C 1/0305 297/411.36
2012/0098318 A1* 4/2012 Chen ..... A47C 1/03 297/411.36
2012/0104823 A1* 5/2012 Lai ..... A47C 1/03 297/411.36
2015/0115683 A1* 4/2015 Huang ..... A47C 1/03 297/411.36
2015/0130250 A1* 5/2015 Masunaga ..... A47C 1/0307 297/411.36
2015/0265058 A1 9/2015 Igarashi et al.
2016/0135603 A1 5/2016 Chan et al.
2016/0227936 A1* 8/2016 Hector ..... A47C 1/03
2017/0027324 A1* 2/2017 Su ..... A47C 1/0307
2020/0054141 A1 2/2020 O'Hara

OTHER PUBLICATIONS

U.S. Appl. No. 16/552,687 U.S. Pat. No. 10,945,530, filed Aug. 27, 2019, Chair With Appendage Accommodations.
"U.S. Appl. No. 15/966,836, Non Final Office Action dated Feb. 5, 2019", 16 pgs.
"U.S. Appl. No. 15/966,836, Notice of Allowance dated May 23, 2019", 12 pgs.
"U.S. Appl. No. 15/966,836, Response filed May 6, 2019 to Non Final Office Action dated Feb. 5, 2019", 7 pgs.
"U.S. Appl. No. 16/552,687, Non Final Office Action dated Aug. 24, 2020", 15 pgs.
"U.S. Appl. No. 16/552,687, Notice of Allowance dated Dec. 4, 2020", 5 pgs.
"U.S. Appl. No. 16/552,687, Preliminary Amendment filed Nov. 19, 2019", 6 pgs.
"U.S. Appl. No. 16/552,687, Response filed Nov. 24, 2020 to Non Final Office Action dated Aug. 24, 2020", 7 pgs.

* cited by examiner

CHAIR WITH APPENDAGE ACCOMMODATIONS

CLAIM OF PRIORITY

This application is a continuation of U.S. patent application Ser. No. 16/552,687, filed on Aug. 27, 2019—now U.S. Pat. No. 10,945,530 B2, which is a continuation of U.S. patent application Ser. No. 15/966,836, filed on Apr. 30, 2018—now U.S. Pat. No. 10,426,269 B1, which are incorporated herein by reference in their entirety.

BACKGROUND

Chairs come in all shapes, sizes, and functional abilities in the industry. For example, chairs are available for general office use: including basic or advanced ergonomic features; applications such as health care, commercial, or special needs applications; and accommodation of different physiques and statures. Buzz Seating conceived and designed the Shield Chair to accommodate maintenance, utility, security, law enforcement or anyone wearing a utility or duty belt that can obstruct the ability to get in or out of a restrictive chair, resulting in damage to the chair and/or the belt contents, or possible injury to the individual.

However, existing chairs fail to adequately accommodate individuals who wear tools or weaponry. Individuals can become encumbered or entangled, restricting motion and access, because of duty belts and associated tools or equipment, such as flashlights, communication devices, manual tools, weaponry and utilitarian accessories. As a result, an individual is forced to remove the contents of the belt or the belt itself before sitting in existing chairs. In some cases, this may even cause a security risk because weaponry has to be removed from a law enforcement officer, military member, or security staff before the user is able to sit in an existing chair. For instance, depending on the circumstances, an officer attempting to sit in an existing chair with attached weaponry could cause an accidental discharge of a weapon or inadvertently cause a safety mechanism to be turned off should the officer forcibly attempt to sit in the chair.

In the case of tools, the tools can be misplaced, lost, or stolen when removed from the individual.

Additionally, when an individual attempts to sit in existing chairs with attached weaponry or tools, the chair can be severely damaged (ripped) or broken. Weaponry and tools tend to be very heavy with sharp/jagged edges, such that functional mechanisms of the chair can break and comfort mechanism of the chair (e.g., upholstery, etc.) can rip or tear. A sturdy chair could also cause the weaponry or tools to be damaged when the individual forcibly attempts to sit in that chair.

Still further and with existing chairs, individuals attempting to sit with attached tool or duty belt may get stuck in the chair when trying to stand up from the chair if they were actually successful in sitting in the chair in the first place.

Thus, there is a need for an approved chair that provides adequate support for individuals wearing attached weaponry and/or tools, promoting safety through ease of movement while allowing access to the duty belt, easing restrictions due to hardware.

SUMMARY

Various embodiments of the invention provide a chair with user appendage accommodations.

Specifically, and in one embodiment, a chair is provided. The chair includes a back member and arm brackets. The back member is tapered toward an end that is adjacent to a seat. The arm brackets are attached under a bottom portion of the seat. Each arm bracket is adjustable 90 degrees to provide a seat clearance area for the seat when one or more of the arm brackets are adjusted 90 degrees from an original upright position.

DETAILED DESCRIPTION

As will be demonstrated herein and below, a chair is provided that provides substantial clearance on the sides and at the back of the seat for an individual to comfortably sit in the chair with attached weaponry or tools.

The following diagrams are presented for illustration and it is to be noted that any dimensions and measurements illustrated represent embodiments of the chair and as such other embodiments may alter those dimensions and measurements without departing from the beneficial teachings presented herein and below.

Figure 1:
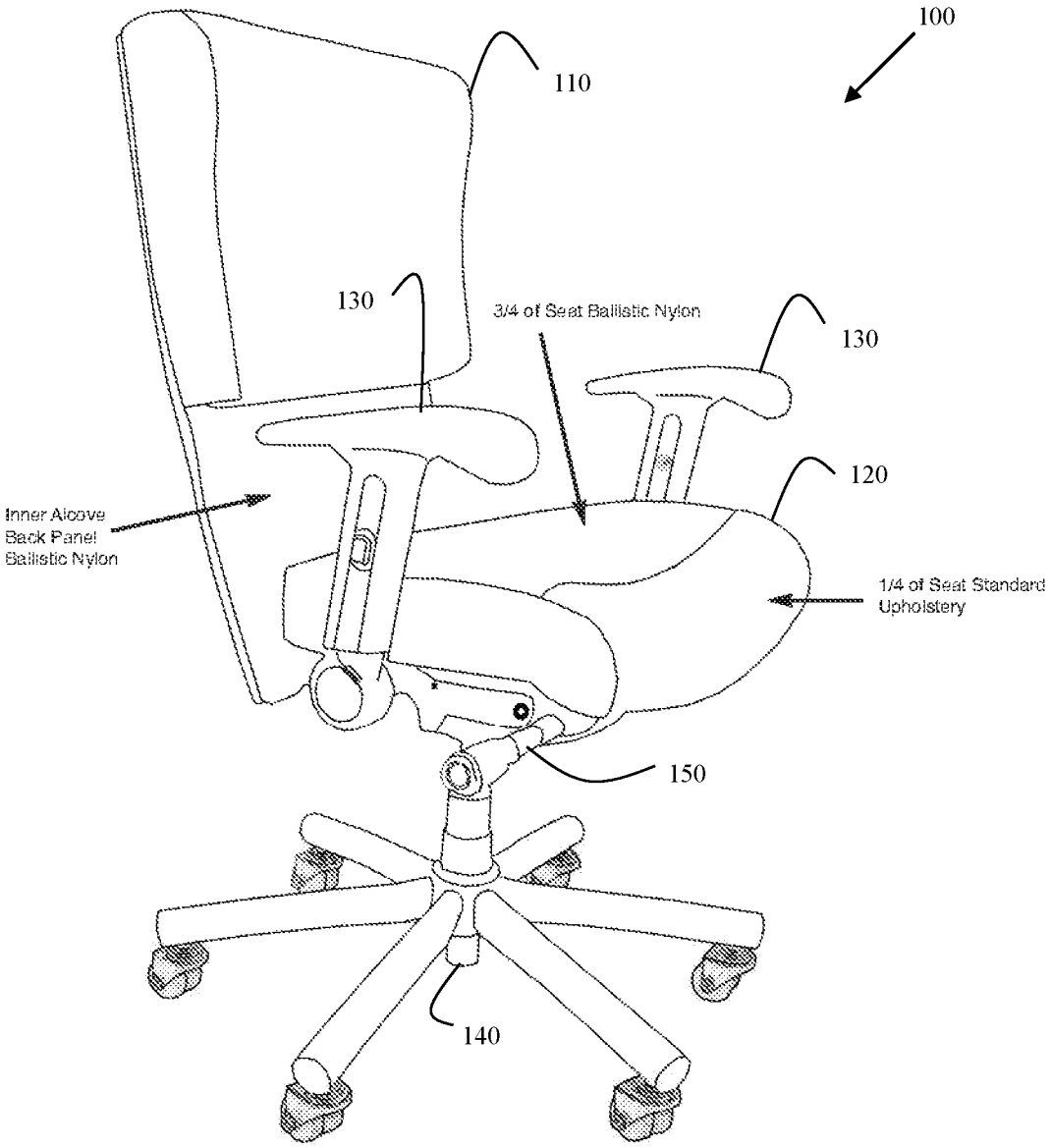
FIG. 1 is a diagram of a chair, according to an example embodiment presented herein.

FIG. 1 is a diagram of a chair 100, according to an example embodiment presented herein.

The chair 100 includes a back (or back member) 110, a seat 120, two retractable arm brackets 130, a base 140, and seat height and seat tilt adjustment levers 150 (just one lever illustrated in the side view of FIG. 1, both levers 150 are fully illustrated in FIG. 14 (discussed below)).

In an embodiment, the back 110 is constructed of multiple materials, with the tapered end that is adjacent to the back of the seat 120 being constructed as an inner alcove back panel upholstered with ballistic nylon material.

In an embodiment, three-quarters of the seat 120 is upholstered in ballistic nylon from the rear and forward. The top surface of the seat is upholstered in ballistic nylon material. The front surface of the (representing ¼ of the overall seat surface area) is upholstered with standard upholstery material.

Figure 2:
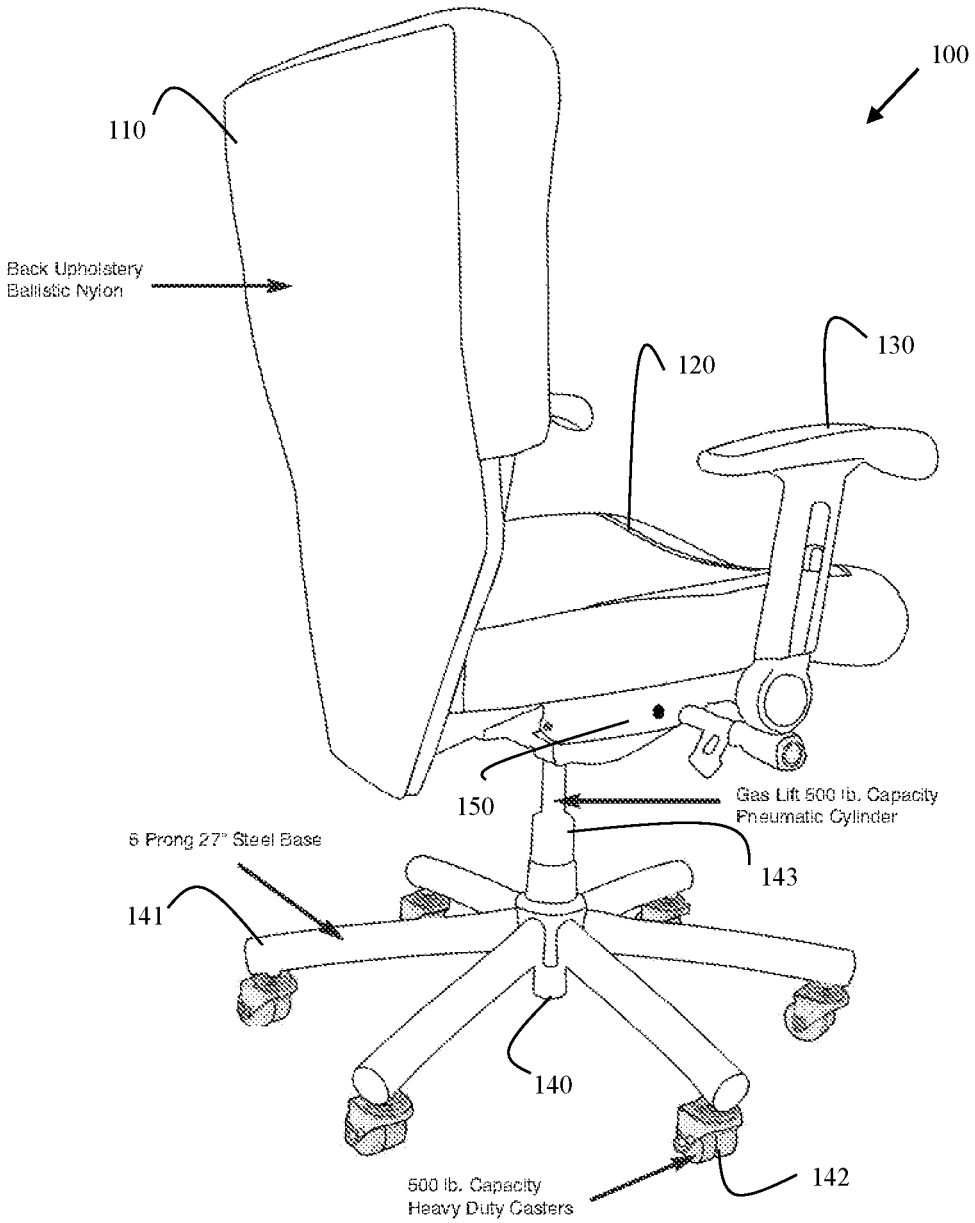
FIG. 2 is a diagram of a side view of the chair, according to an example embodiment.

FIG. 2 is a diagram of a side view and back of the chair 100, according to an example embodiment.

In an embodiment, a back surface of the back 110 is upholstered with ballistic nylon material.

The base 140 includes 6 legs 141, each leg 141 having a caster 142. The base also includes a cylinder 143.

In an embodiment, each wheel 142 is a heavy duty caster.

In an embodiment, the cylinder 143 is a gas lift 500 pound capacity pneumatic cylinder.

Figure 3:
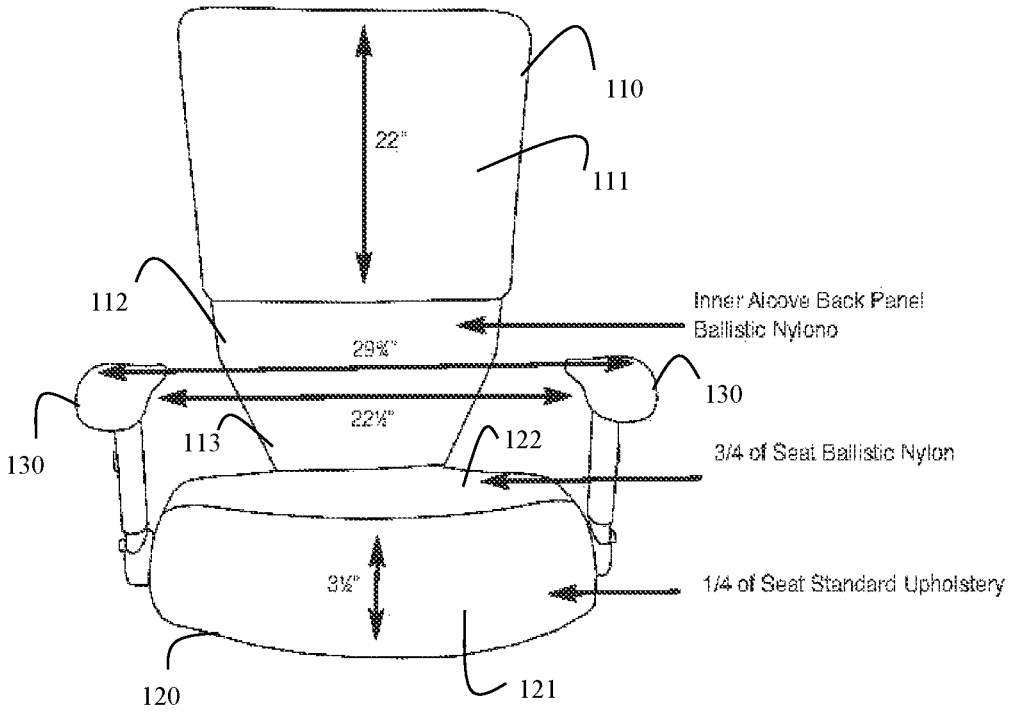
FIG. 3 is a diagram of a front view of the chair's back, seat, and arm brackets, according to an example embodiment.

FIG. 3 is a diagram of a front view of the chair's back 110, seat 120, and arm brackets 130, according to an example embodiment.

The back 110 includes three sections. The first section 111 extends from the top towards the seat 120 for approximately 22 inches. The second section 112 comes down 3.5 inches and then tapers from an end of the first section 111 at an angle of approximately 22 degrees and extends through the third section 113.

In an embodiment, a largest width of the seat 120 is approximately 22.5 inches.

In an embodiment, the distance between the arm brackets 130 is approximately 29.75 inches.

In an embodiment, a height of the front surface 121 of the seat 120 is approximately 3.5 inches thick.

Figure 4:
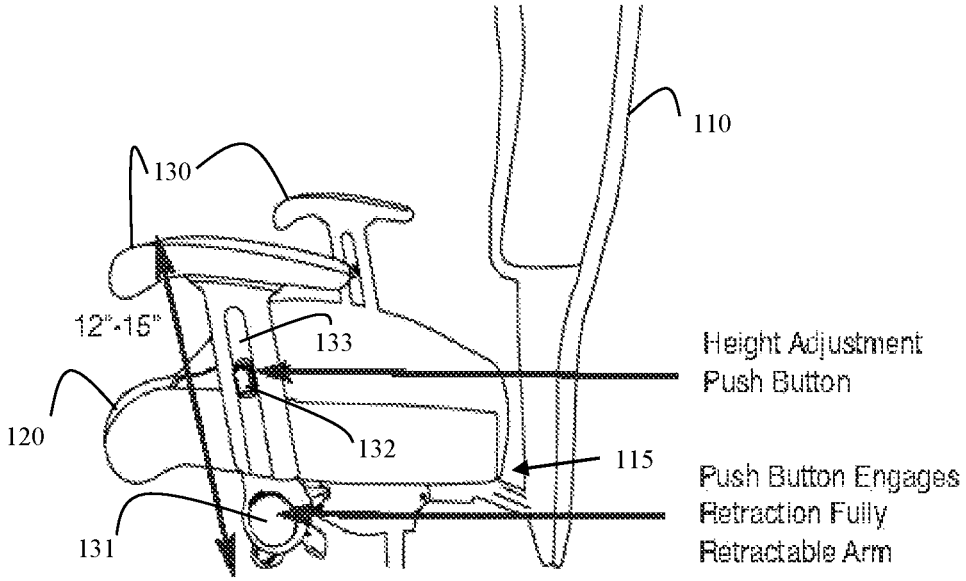
FIG. 4 is a diagram of a side view of arm brackets of the chair, according to an example embodiment.

FIG. 4 is a diagram of a side view of arm brackets 130 of the chair, according to an example embodiment.

The back 110 is attached to the seat 120 under the seat 120 and at the back of the seat 120. There is a gap 115 that exists between a back surface of the seat 120 and a front surface of the third portion 113 of the back 110.

Each arm bracket 130 is adjustable up and down and side to side. A height adjustment mechanism 132 when activated allows the arm brackets 130 is adjust up and down through slot 133.

In an embodiment, the height adjustment mechanism 132 is a button that, when depressed, allows the arm bracket 130 to slide up and down to adjust its height through the slot 133; when the button is released it locks into the slot 133 fixing the height of the arm bracket 130 at a user-adjusted position.

In an embodiment, the height adjustment from a base of the slot 133 ranges between approximately 12 to 15 inches.

The height adjustment mechanism 132 allows the brackets 130 to adjust while in a perpendicular position to the top surface of the seat 120.

Each arm bracket 130 also includes a retractable adjustment mechanism 131 that permits the arm bracket 130 to move forward and rearward relative to a side surface of the seat 120. The range of motion is approximately 90 degrees to the rearward position from its original upright position (shown in the FIG. 4) to each side (towards the front of the seat along the side and towards the back of the seat along the side).

Figure 5:
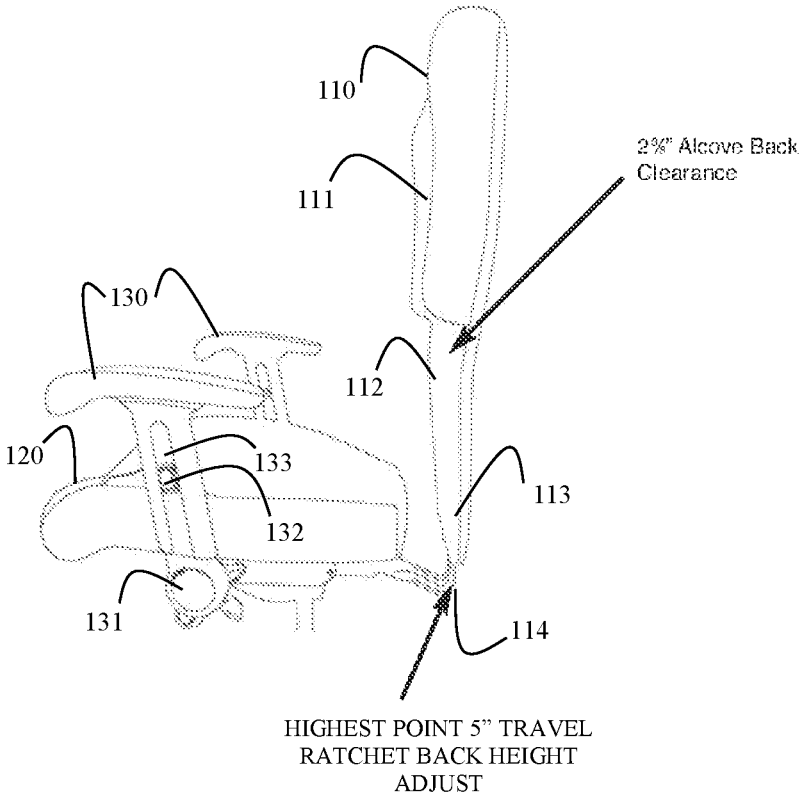
FIG. 5 is a diagram of a side view of the arm brackets and back of the chair, according to an example embodiment.

FIG. 5 is a diagram of a side view of the arm brackets 130 and back of the chair 110, according to an example embodiment.

In an embodiment, the back 110 is attached under the seat 120 at the back of the seat through a ratchet mechanism 114. The mechanism 114 allows the height of the back 110 to be adjusted up or down within a range of approximately 5 inches. The FIG. 5 illustrates the highest point of adjustment for the mechanism 114.

Figure 6:
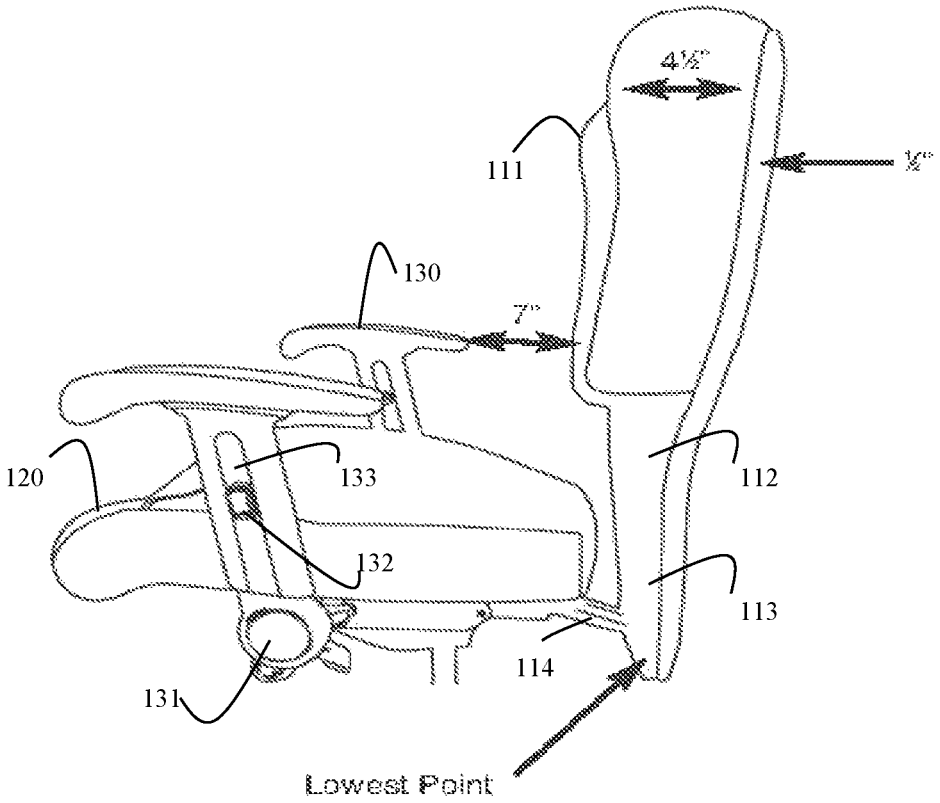
FIG. 6 is a diagram of another side view of the arm brackets and back of the chair, according to an example embodiment.

FIG. 6 is a diagram of another side view of the arm brackets 130 and back 110 of the chair, according to an example embodiment.

In an embodiment, the first portion 111 of the back 110 is approximately 4.5 inches thick with an additional 0.5 inch in thickness along the back of the back 110.

In an embodiment, a distance between back edges of the brackets 130 to a front surface of the first portion 111 of the back 110 is approximately 7 inches.

The FIG. 6 also illustrates the back 110 at its lowest height adjustment point made through the mechanism 114.

Figure 7:
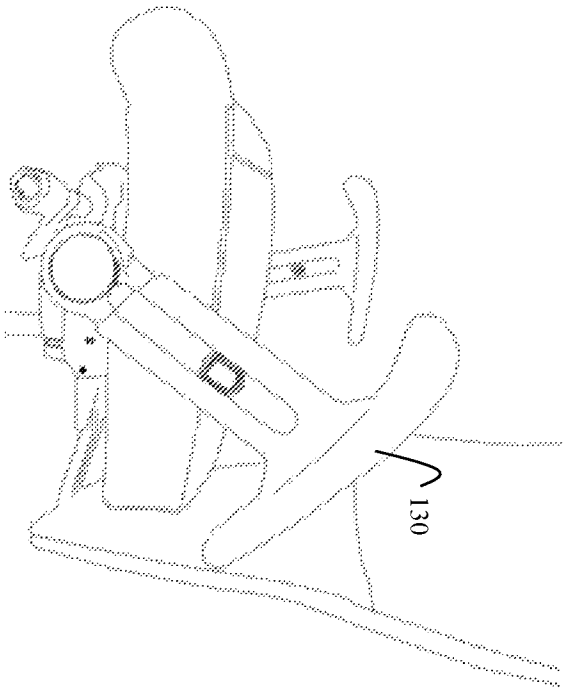
FIG. 7 is a diagram of one arm bracket being adjustably moved to a first position, according to an example embodiment.

FIG. 7 is a diagram of one arm bracket 130 being adjustably moved to a first position, according to an example embodiment.

FIG. 7 illustrates adjustable movement of the arm bracket 130 from an original upright position (illustrated in the FIG. 6) towards the back 110.

Figure 8:
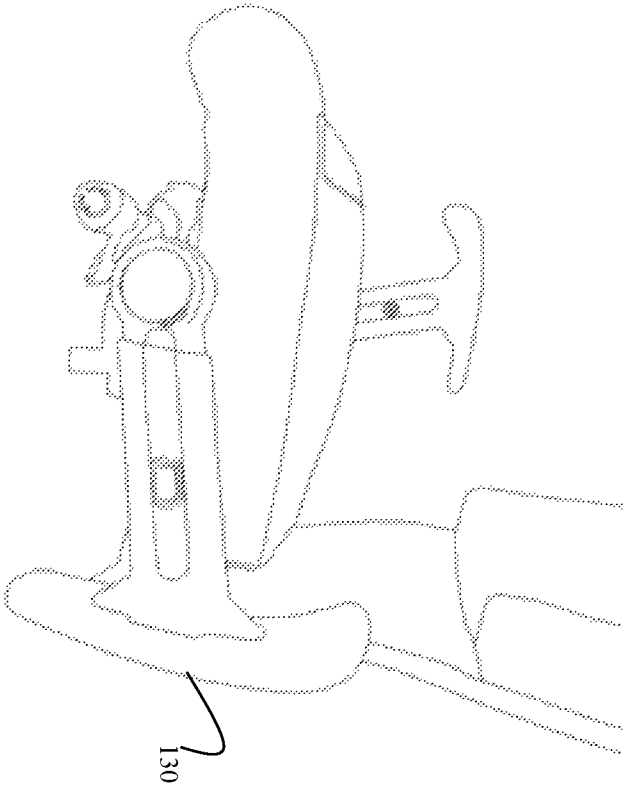
FIG. 8 is a diagram of the arm bracket depicted in the FIG. 7 being adjustably moved to a second position, according to an example embodiment.

FIG. 8 is a diagram of the arm bracket 130 depicted in the FIG. 7 being adjustably moved to a second position, according to an example embodiment.

FIG. 8 illustrates the arm bracket 130 moving from its position illustrated in the FIG. 7 to a full 90 degree range of motion toward the back 110.

It is noted that when the arm brackets 130 are adjustably moved forward and rearward, the seat clearance area is substantially increased for someone with attached weaponry or tools because the brackets 130 no longer exist to restrict the seat (side to side) clearance area when sitting in the chair 100.

Figure 9:
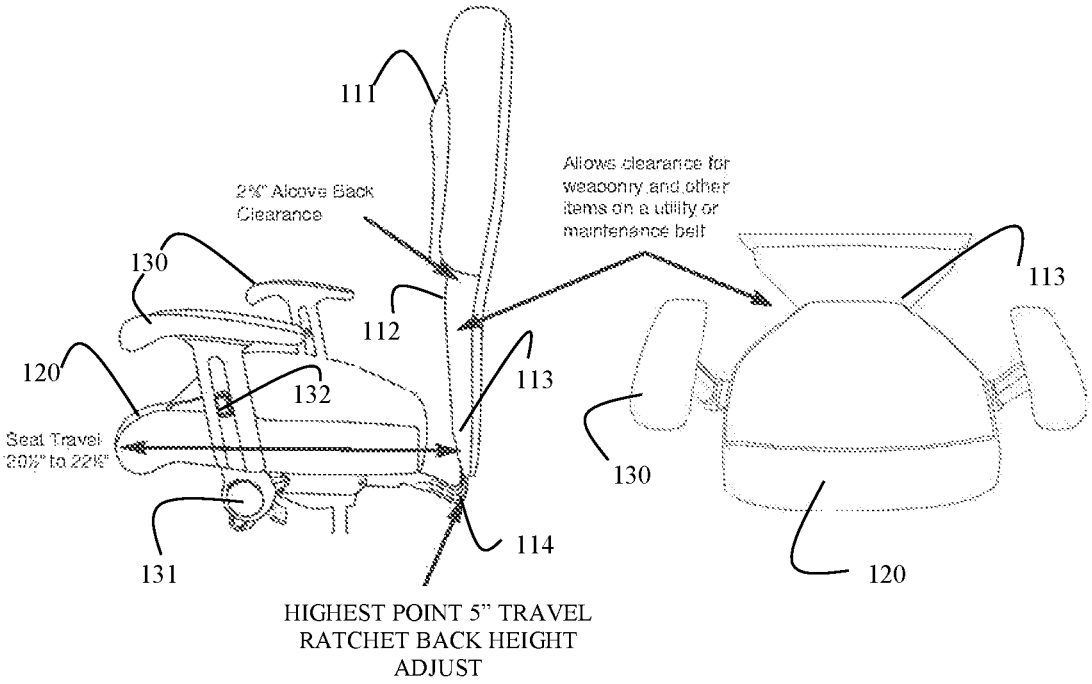
FIG. 9 are diagrams of a side view of the chair and a front view of the seat with a portion of the back, according to an example embodiment.

FIG. 9 are diagrams of a side view of the chair 100 and a front view of the seat 120 with a portion of the back 110, according to an example embodiment.

In an embodiment, the width of the second portion 112 is approximately 2⅜$^{th}$ of an inch.

In an embodiment, the seat tilt and forward to rearward adjustment lever 150 allows the seat 120 to move in a parallel manner to a surface upon which the chair 100 is placed from a range of 20.5 inches to 22.5 inches; and allows the seat 120 to tilt at an angle.

The tapering of the back 110 from the first portion 111 to the second portion 112 and the second portion 112 to the third portion 113 as well as the tapering of the seat 120 from front to back provides additional clearance area for individuals with attached weaponry or tool utility belts. The width distance between the first portion 111 vis-à-vis the second 112 and third portions 113 also provides additional clearance area. Furthermore, the adjustment of the brackets 130 still provides forward to rearward clearance area.

Also, the additional thickness of the first portion 111 provides adequate upper back support for the individual sitting in the chair 100 while having attached weaponry or utility belt with tools.

Figure 10:
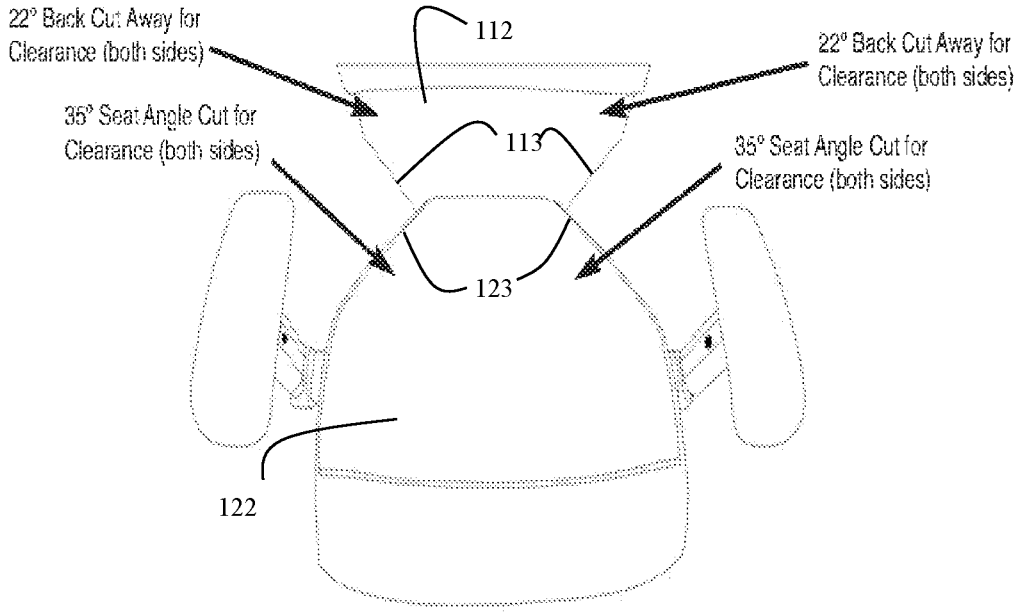
FIG. 10 is a diagram of another front view of the seat with the portion of the back, according to an example embodiment.

FIG. 10 is a diagram of another front view of the seat 120 with the portion of the back 110, according to an example embodiment.

The third portion 113 is tapered at an angle from the second portion 112 of 22 degrees that extends to the mechanism 114.

The seat 120 is tapered beginning at approximately an area on the seat 120 adjacent to the brackets 130 at an angle of approximately 35 degrees that extends to the back of the seat 120.

This illustrates the additional amount of clearance area towards the back of the seat 120 and at the back 110 for an individual with attached weaponry or a utility belt.

Figure 11:
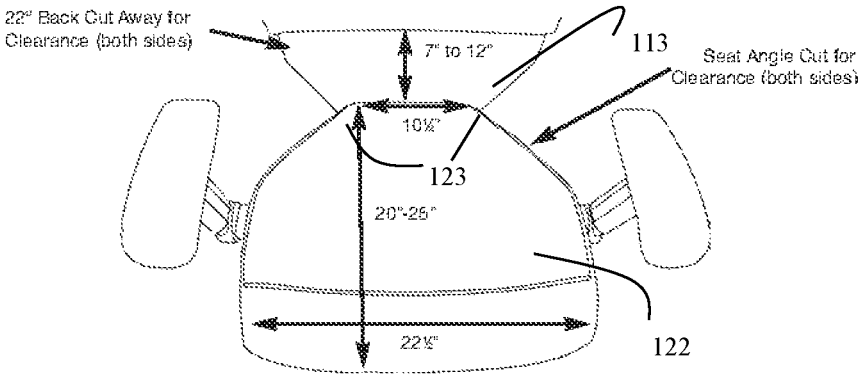
FIG. 11 is a diagram of still another front view of the seat with the portion of the back, according to an example embodiment.

FIG. 11 is a diagram of still another front view of the seat 120 with the portion of the back 110, according to an example embodiment.

In an embodiment, the third portion 113 and second portion 112 have a height extending from behind the back of the seat 120 to the first portion 111 of approximately 7 to 12 inches.

In an embodiment, the back fully tapered end of the seat 120 has a width of approximately 10.5 inches.

In an embodiment, the widest portion of the seat 120 at the front surface 121 is approximately 22.5 inches and the length of the seat 120 extending from the front to the back is approximately 20 to 25 inches.

Again, the tapered nature of the seat 120 and the back provide additional back clearance area when an individual with attached appendages (weaponry and/or tool belt) is sitting in the chair 100.

Figure 12:
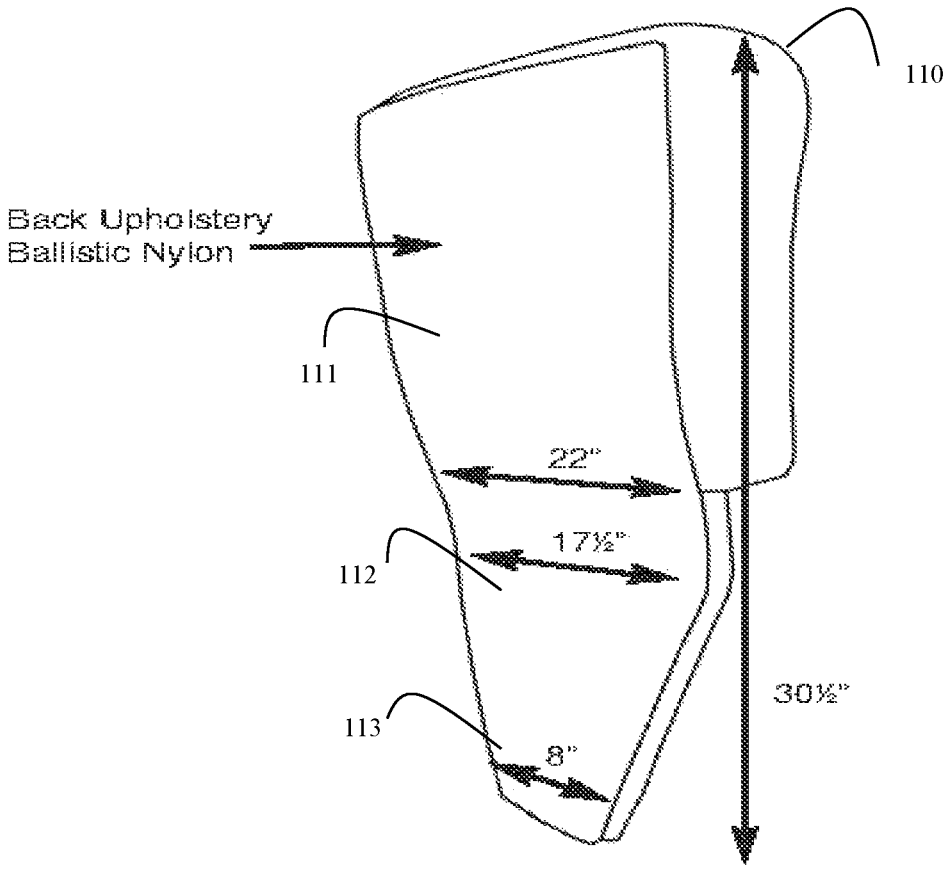
FIG. 12 is a back and side view of the back, according to an example embodiment.

FIG. 12 is a back and side view of the back 110, according to an example embodiment.

In an embodiment, the length of the back 110 or height of the back 110 is approximately 30.5 inches. The width of the first portion 111 is approximately 22 inches, the second portion 112 is approximately 17.5 inches, and the third portion 113 is approximately 8 inches.

The third portion 113 converges adjacent to the back of the seat (which is tapered and has a reduced width as illustrated in the FIG. 11).

Figure 13:
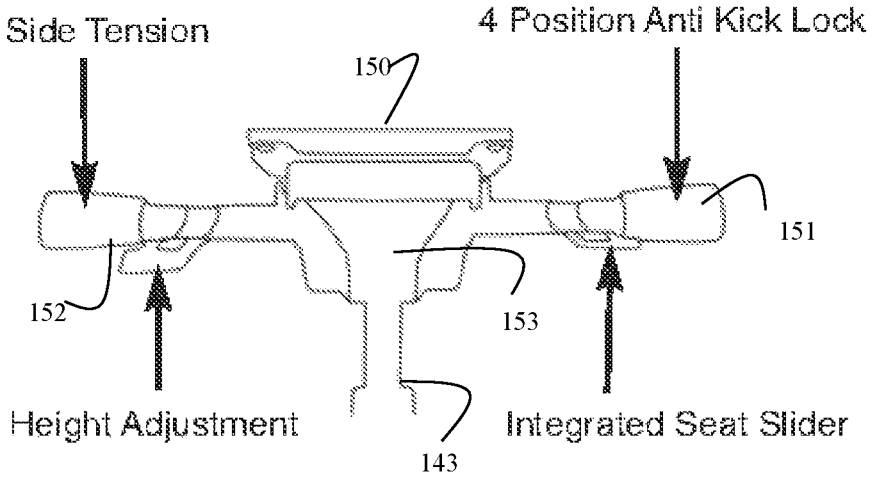
FIG. 13 is a diagram of adjustment mechanisms for the chair, according to an example embodiment.

FIG. 13 is a diagram of adjustment mechanisms 150 for the chair 100, according to an example embodiment.

The adjustment mechanisms 150 are attached to the cylinder 143 of the base 140 and a bottom surface of the seat 120.

The adjustment mechanism 150 includes two levers 151 and 152 that extend side to side on each side under the seat 120, such that an individual sitting in the chair 100 can access with either hand one of the levers. A center portion 153 of the mechanism 150 provides stability, balance, and separates the two levers 151 and 152.

In an embodiment, the lever 152 includes a tilt tension adjustment and a seat height adjustment handle.

In an embodiment, the lever 151 includes a 4 position anti kick lock and an integrated seat slider handle, such that the seat can be adjusted front to back and tilted.

One now appreciates how substantial side to side sitting clearance area is increased through the retractable brackets 130 and how back sitting clearance is increased through the tapering of the back 110, the seat 120, the width of the third portion 113, the width of the back of the seat 120, and the gap 115 between the back of the seat 120 and front surface of the third portion 113 of the back 110. This provides substantial clearance area for an individual sitting in the chair 100 with attached appendages on his/her person (such as weaponry and utility belts with tools).

The above description is illustrative, and not restrictive. Many other embodiments will be apparent to those skilled in the art upon reviewing the above description. The scope of embodiments should therefore be determined with reference to the appended claims, along with the full scope of equivalents to which such claims are entitled.

The invention claimed is:

1. A chair comprising:

a chair back that tapers from a top to a bottom, wherein the bottom is adjacent to a chair seat, wherein the chair back comprises three portions, the first portion extends from the top towards the chair seat and tapers to the second portion, the second portion drops down from the first section for approximately 3.5 and then tapers to the third portion, and the third portion extends from the second portion and tapers to a ratchet mechanism affixed under a bottom of the chair seat, wherein a first thickness or first width of the first portion is greater than a second thickness or second width of the second portion and the second thickness or second width is greater than a third thickness or third width of the third portion;

the chair seat that tapers from a front to a back, wherein the back is adjacent to the chair back;

retractable arm rests, each retractable arm rest comprises a retractable adjustment that allows the corresponding retractable arm rest to pivot forwardly to rest adjacent to a first side portion of a given side of the chair seat and each retractable arm rest adapted to pivot rearwardly to rest adjacent to a second side portion of the given side of the chair seat, wherein each retractable adjustment allows the corresponding arm rest to have a range of motion of approximately 180 degrees, wherein each retractable arm rest further comprises an arm rail with a height adjustment mechanism that when activated allows the corresponding retractable arm rest to adjust up and down through a slot in the corresponding arm rail, each retractable arm rest affixed to a top of the corresponding arm rail; and a base attached under the chair seat comprising legs, each leg comprising a caster, wherein the base comprises six legs.

2. The chair of claim 1, wherein a gap exists between the bottom of the chair back and the back of the chair seat.

3. The chair of claim 1, wherein a rear and side sitting clearance area is defined by the third portion a first portion of the bottom of the chair back, a second portion of the back for the chair seat, and at least one of the retractable arm rests in a retracted position.

4. The chair of claim 3, wherein the rear and side sitting clearance area is sufficient to accommodate a person sitting in the chair while wearing a tool belt, a duty belt, or while carrying weaponry.

5. The chair of claim 1, wherein the chair back and the chair seat are at least partially upholstered in a ballistic nylon.

6. The chair of claim 1, wherein the base further comprises a pneumatic cylinder adapted to raise and lower the chair seat.

7. The chair of claim 1, wherein the retractable arm rests are affixed along sides of the chair seat.

8. The chair of claim 1, wherein the ratchet mechanism is adapted to adjust a height of the chair back.

9. A chair, comprising:

a chair back attached to a chair seat adjacent to a rear surface of the chair seat with a gap between a bottom of the chair back and a back of the chair seat, wherein the chair back comprises three portions, the first portion extends from the top towards the chair seat and tapers to the second portion, the second portion drops down from the first section for approximately 3.5 and then tapers to the third portion, and the third portion extends from the second portion and tapers to a ratchet mechanism affixed under a bottom of the chair seat, wherein a first thickness or first width of the first portion is greater than a second thickness or second width of the second portion and the second thickness or second width is greater than a third thickness or third width of the third portion;

the chair seat tapered from a front to the back;

arm rests attached along sides of the chair seat, wherein each arm rest comprises a retractable adjustment that allows the corresponding retractable arm rest to pivot forwardly and rearwardly, each retractable adjust allows the corresponding arm rest to pivot forwardly to rest adjacent to a first side portion of a given side of the chair seat and each retractable adjustment also allows the corresponding arm rest to pivot rearwardly to rest adjacent to a second side portion of the given side of the chair seat, wherein each retractable adjustment allows the corresponding arm rest to have a range of motion of approximately 180 degrees, wherein each arm rest further comprises an arm rail with a height adjustment mechanism that when activated allows the corresponding arm rest to adjust up and down through a slot in the corresponding arm rail, each arm rest affixed to a top of the corresponding arm rail; and a base comprising six legs, each of the six legs comprises a caster.

10. The claim of claim 9, wherein the chair seat is upholstered in a ballistic nylon.

11. The claim of claim 9, wherein each arm rest comprises a retractable adjustment mechanism to lower, fold, or retract the corresponding arm rest from an original upright position rearward towards the chair back into a rearward position.

12. The claim of claim 9, wherein the base further comprises a gas lift to raise and lower the chair seat.

13. The claim of claim 9, wherein the base further comprises an integrated seat slider mechanism to slide the chair seat forward and backward.

14. The claim of claim 9, wherein the base further comprises a tilt tension adjustment mechanism to tilt the chair seat to a selected angle.

15. A chair, comprising:

a recessed chair back attached to a tapered chair seat, wherein the recessed chair back comprises three portions, the first portion extends from atop of the recessed chair back towards the chair seat and tapers to the second portion, the second portion drops down from the first section for approximately 3.5 and then tapers to the third portion, and the third portion extends from the second portion and tapers to a ratchet mechanism affixed under a bottom of the chair seat, wherein a first thickness or first width of the first portion is greater than a second thickness or second width of the second portion and the second thickness or second width is greater than a third thickness or third width of the third portion;

the tapered chair seat attached to a base;

retractable arm rests attached along sides of the tapered chair seat; and a base attached to six legs, and each leg comprises a caster;

wherein a back and side sitting clearance area is defined by a back of the tapered chair seat, the third portion of the recessed chair back, the gap, and at least one of the retractable arm rests in a lowered or a retracted position;

wherein the back and side sitting clearance area is sufficient to allow a person sitting in the chair while wearing a tool belt, a duty belt, or while carrying weaponry;

each retractable arm rest comprises a retractable adjustment that allows the corresponding retractable arm rest to pivot forwardly to rest adjacent to a first side portion of a given side of the tapered chair seat and each retractable adjustment allows the corresponding retractable arm rest to pivot rearwardly to rest adjacent to a second side portion of the given side of the tapered chair seat, wherein each retractable adjustment allows the corresponding arm rest to have a range of motion of approximately 180 degrees, wherein each retractable arm rest further comprises an arm rail with a height adjustment mechanism that when activated allows the corresponding retractable arm rest to adjust up and down through a slot in the corresponding arm rail, each retractable arm rest affixed to a top of the corresponding arm rail.

16. The chair of claim 15, wherein at least a portion of the tapered chair seat is upholstered in a ballistic nylon.

* * * * *